United States Patent [19]

Noel

[11] 4,331,356

[45] May 25, 1982

[54] HASP RETAINING DEVICE

[75] Inventor: Brian F. Noel, Stuart, Fla.

[73] Assignee: Voyager Marine Products, Inc., Stuart, Fla.

[21] Appl. No.: 123,067

[22] Filed: Feb. 20, 1980

[51] Int. Cl.[3] ..... E05C 19/08

[52] U.S. Cl. ..... 292/281

[58] Field of Search ..... 292/17, 281–287, 292/DIG. 39; 339/252 P

[56] References Cited

U.S. PATENT DOCUMENTS

| | | | |
|---|---|---|---|
| 258,561 | 5/1882 | Dewar | 339/252 P |
| 1,061,032 | 5/1913 | Baker | 292/281 |
| 1,448,338 | 3/1923 | Drew | 292/17 X |
| 1,749,983 | 3/1930 | Nelson | 292/281 |
| 1,771,184 | 7/1930 | McLaughlin | 292/17 X |
| 2,543,913 | 3/1951 | Krouse | 292/17 X |

FOREIGN PATENT DOCUMENTS

| | | | |
|---|---|---|---|
| 704450 | 3/1941 | Fed. Rep. of Germany | 339/252 P |
| 5705 | of 1892 | United Kingdom | 292/281 |

OTHER PUBLICATIONS

"Popular Mechanics", p. 188 of Oct. 1950 Issue, Paragraph Entitled Screw Eye Holds Hasp Open.

*Primary Examiner*—Richard E. Moore

*Attorney, Agent, or Firm*—Berman, Aisenberg & Platt

[57] ABSTRACT

A hasp includes a conventional hinged slotted member for cooperation with a hasp staple. One or more arcuate spring-like members extend between the ends of the staple. The spring-like members are resilient such that when the slot of the hinged member is received by the staple and a force is applied to the hinged member, the spring-like members will compress allowing the hinged member to pass thereover, but thereafter the spring-like members will recover their arcuate form and thereby retain the hinged member in place.

5 Claims, 4 Drawing Figures

HASP RETAINING DEVICE

BACKGROUND OF THE INVENTION

The present invention relates to hasps in general, and more particularly to a hasp staple having means for retaining a hasp hinged member in cooperating relationship therewith.

In the conventional hasp, after the slot of the hinged member has been received by the staple, it is usually necessary to affix a padlock or pin to the staple in order to maintain the hinged member in its received position. However, when the structure to which the hasp has been mounted is frequently opened and closed, the use of a padlock or pin may be a considerable inconvenience. Especially in marine applications and the like, if the hinged member is not maintined in its received position with the staple, the hinged member will tend to flap about becoming a potential hazard as well as generating unwanted noise.

There have been modifications and improvements in the past to keep the components of a hasp in engagement with each other without the need of a padlock or pin. Such devices have been disclosed in the patents to Wagner, U.S. Pat. No. 1,094,279; Nelson, U.S. Pat. No. 1,749,983; Fulton, U.S. Pat. No. 3,141,536; Scelba, U.S. Pat. No. 3,598,436; British Pat. No. 5,705 to Martineau; and British Pat. No. 279,611 to Skeldings Limited.

It is an object of the present invention to improve upon the hasps used in the past, and particularly the hasp staple, and provide a more convenient and efficient device.

It is a further object of the present invention to provide a hasp wherein the elements engage and disengage each other smoothly and readily. These objects and others will become more apparent from the subsequent discussion of the present invention.

SUMMARY OF THE INVENTION

The present invention particularly relates to a hasp staple which is adapted for cooperation with the hinged slot member of a hasp. The hasp staple includes one or more spring-like members which extend arcuately along the staple. The spring-like members are sufficiently resilient so that upon the application of a force to the hinged member and the engagement of the periphery of the hinged member slot with the spring-like members, the spring-like members are compressed towards the staple thereby permitting the hinged member to pass thereover. After the hinged member has passed over the staple, the resilient spring-like members resume their arcuate form thereby to retain the hinged member in its received position.

DETAILED DESCRIPTION OF THE INVENTION

Referring to the Figures, the hasp staple of the present invention is designated as 10. In order to describe the present invention, it is discussed with respect to the hinged slotted member 12 of a conventional hasp. Hinged member 12 is pivotable on a base member 14 secured to a structure S by means of screws 16. The slot formed in the hinged member 12 is designated as 18.

Figure 4:
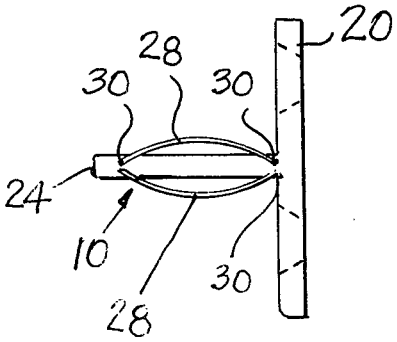
FIG. 4 is a side view of the hasp staple of the present invention.

Hasp staple 10 extends outwardly and substantially perpendicular from a staple base 20 having openings therein to accommodate mounting screws 22. Disposed along the length of the staple 10, between its distal end 24 and its opposite end 26, i.e., the end from which it emerges from the staple base 20, are one or more spring-like members 28. Spring-like members 28 are formed of thin strips of a flexible but sturdy material, such as stainless steel, and are arcuate in shape as they extend along and outwardly from the staple 10. Each end of the spring-like members 28 is secured within a groove 30 formed within the staple 10, reference FIG. 4.

In the Figures a pair of spring-like members 28 are depicted on opposing surfaces of the staple 10. However, it is anticipated that the operation of the present invention can be achieved with only one spring-like member 28. An opening 32 is also provided in the staple 10 for the accommodation of a hasp of a conventional locking device, i.e., a padlock.

Figure 1:
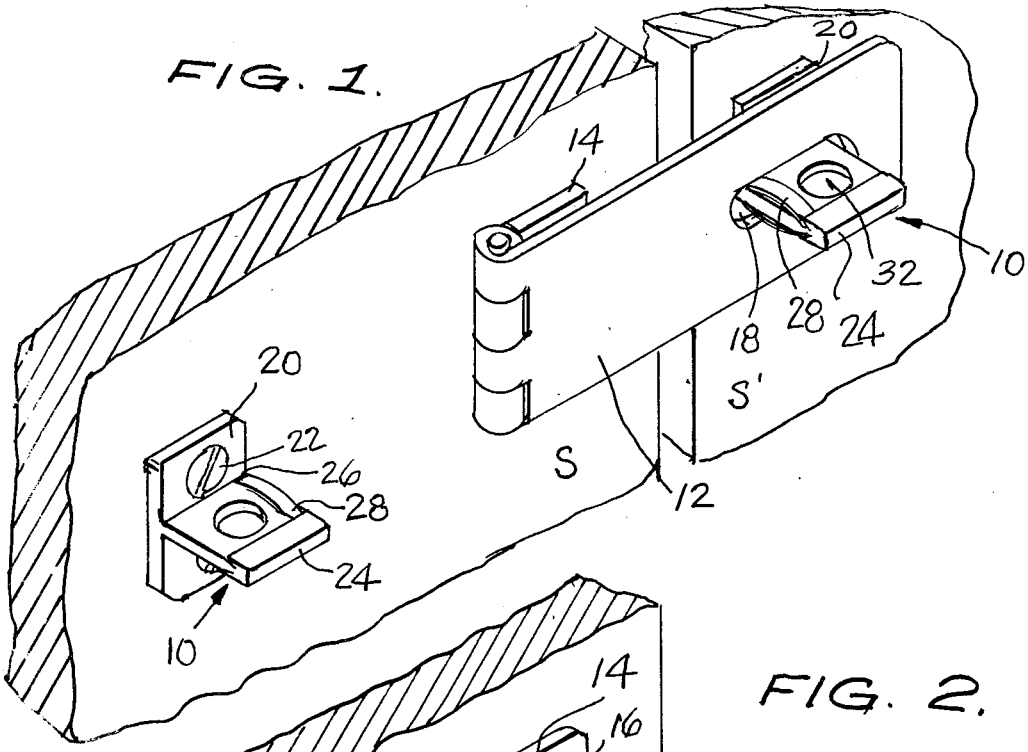
FIG. 1 is a perspective view of a hasp utilizing the hasp staple of the present invention wherein a hinged slotted member is received by the hasp staple mounted to a structure separate but adjacent the structure to which the hinged member is mounted.
Figure 2:
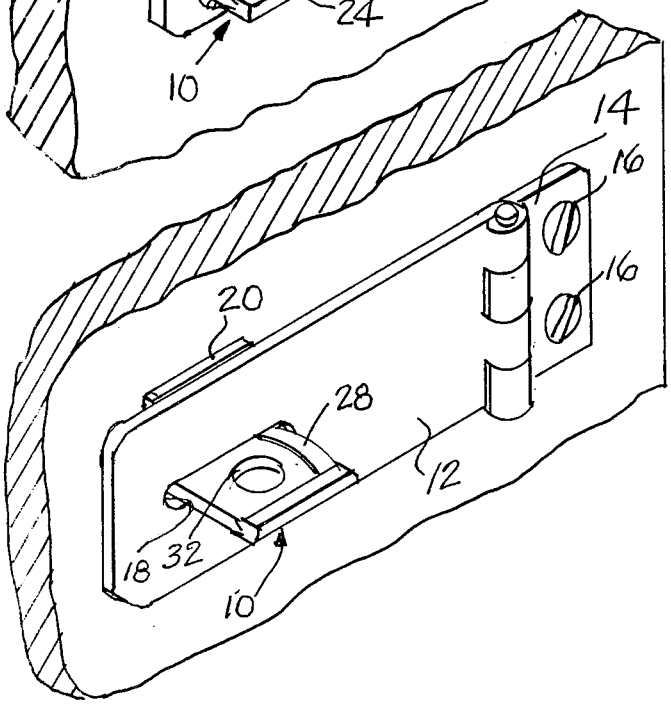
FIG. 2 is a fragmentary perspective view of the hasp shown in FIG. 1, wherein the hinged member is received by a hasp staple mounted on the same structure as the hinged member.
Figure 3:
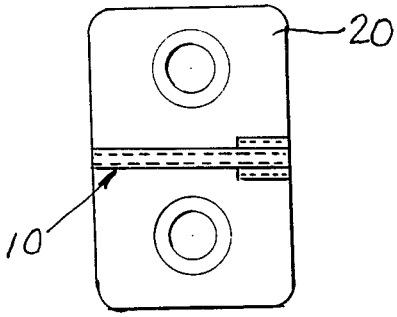
FIG. 3 is a top elevational view of the hasp staple of the present invention.

In the utilization of the present invention, base member 14 is secured to a structure S, while a staple 10 by means of base 20 is disposed on and adjacent structure S'. The base member 14 and staple base 20 are so disposed on their respective structures that upon applying a displacement force to hinged member 12 it may be received by the staple 10. Upon the staple 10 receiving the hinged member 12, the spring-like members 28 engage the periphery of slot 18 causing the spring-like members to be compressed towards the staple 10 and thereby allowing the hinged member 12 to pass thereover. Thus, it is preferable that the spring-like members 28 are of a resilient material to accommodate and accept the compressive forces from the slot periphery 18, but the resiliency of the spring members 28 must be such as to allow them to resume their arcuate form after the hinged plate 12 has passed thereover. It is because the spring-like members 28 resume their arcuate form that the hinged member 12 is thereby retained in this received position, as shown in FIGS. 1 and 2.

It is further preferable that the spring-like members 28 be arcuate to a predetermined measure relative to the width of the slot 18, so as to permit the hinged member 12 to pass thereover and thereafter to retain the hinged member 12 in its received position.

Either engagement or disengagement of the hinged member 12 and the spring-like members 28 is accomplished in a very smooth manner because of the arcuate form of the spring-like members 28.

Of course, once the hinged member 12 is retained in its received position by the staple 10, the hasp of a padlock can be inserted through the opening 32 to provide a more secure locking of the hinged member 12 to the staple 10.

It is further anticipated that a second staple 10, as shown in FIGS. 1 and 2, may also be provided on the same structure to which the hinged member 12 is mounted. In those instances where there is no need for the hinged member 12 to be received by the staple 10 on an adjacent structure, the second staple 10 can be utilized for retaining the hinged plate 12 in a secured position and thereby preventing the hinged plate 12 from creating a possible hazard.

While this invention has been described with respect to a specific embodiment, it is not limited thereto. The appended claims therefore are intended to be construed to encompass all forms and embodiments of the invention, within its true spirit and scope.

What is claimed is:

1. In a hasp, including a hinged, slotted part and a staple, where the staple is a rigid member which cooperates with the slot in the hinged part, the improvement comprising:

retaining means on said staple comprising:

an arch on at least one side of said staple and extending from said staple near one end of said staple to said staple near the other end of said staple, said arch being deformable to allow the perimeter of said slot to slide over the staple and said arch when deformed, the height of said arch, when not deformed, being such that said arch retains said hinged slotted part on said staple.

2. The combination of claim 1 further comprising:

one of said arches on each of two opposing sides of said staple.

3. The combination of claim 1 wherein the staple has at least one groove for accommodating one end of said arch.

4. The combination of claim 1 wherein said staple has a hole therein, in a portion of said staple adjacent said arch, for receiving a lock.

5. The combination of claim 1 further comprising, a second staple located on a line containing said hinged, slotted part and said staple, said hinged slotted part being located between said staple and said second staple, said second staple having said retaining means thereon, whereby said hinged, slotted part may be retained by either said staple or said second staple.

* * * * *